US006205926B1

(12) United States Patent
Dufour

(10) Patent No.: US 6,205,926 B1
(45) Date of Patent: Mar. 27, 2001

(54) METHOD FOR ON THE RUN PLATE CHANGES IN OFFSET WEB-FED PRESS

(75) Inventor: Charles H. Dufour, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/178,208

(22) Filed: Oct. 23, 1998

(51) Int. Cl.[7] ..... B41F 1/16; B41F 3/34; B41F 7/02; B41F 9/01; B41F 5/16

(52) U.S. Cl. ..... 101/492; 101/177; 101/217; 101/182; 101/184; 101/185; 101/218

(58) Field of Search ..... 101/176–182, 101/216, 219, 217, 218, 144, 485, 247, 177, 183–185, 220, 248

(56) References Cited

U.S. PATENT DOCUMENTS

| | | | | |
|---|---|---|---|---|
| 3,724,368 | * | 4/1973 | Treff | 101/248 |
| 4,458,591 | * | 7/1984 | Guaraldi | 101/247 |
| 4,643,090 | * | 2/1987 | McKrell et al. | 101/218 |
| 4,696,229 | * | 9/1987 | Bezler et al. | 101/177 |
| 4,932,321 | * | 6/1990 | Hermach | 101/211 |
| 5,063,844 | | 11/1991 | Fausel . | |
| 5,337,664 | * | 8/1994 | Hannon | 101/218 |
| 5,381,734 | | 1/1995 | Becker . | |
| 5,617,788 | * | 4/1997 | Horiguchi et al. | 101/181 |
| 5,699,735 | * | 12/1997 | Stein et al. | 101/219 |
| 5,826,505 | * | 10/1998 | Volz et al. | 101/183 |
| 5,983,794 | * | 11/1999 | Emery | 101/217 |

FOREIGN PATENT DOCUMENTS

| | | |
|---|---|---|
| 44 05 658 | 9/1995 | (DE) . |
| 0 196 018 | 10/1986 | (EP) . |
| 2309668 | 8/1997 | (GB) . |

* cited by examiner

*Primary Examiner*—Kimberly Asher
(74) *Attorney, Agent, or Firm*—Kenyon & Kenyon

(57) ABSTRACT

A printing unit in a lithographic web fed rotary printing press has a plate cylinder and an associated blanket cylinder mechanically coupled via a gear train. A first drive motor drives both the plate cylinder and blanket cylinder. An impression cylinder is associated with the blanket cylinder, the impression cylinder being in rolling contact with the blanket cylinder and being driven by a second drive motor. The web passes through a nip formed between the impression cylinder and the blanket cylinder for printing. A clutch is provided for interrupting a drive connection between the first drive motor and the blanket cylinder, as is a throw-off mechanism for separating the plate cylinder from the blanket cylinder. With the printing unit, the blanket cylinder can remain in rolling contact with the impression cylinder and be friction-driven by the web after the drive connection has been interrupted.

9 Claims, 4 Drawing Sheets

METHOD FOR ON THE RUN PLATE CHANGES IN OFFSET WEB-FED PRESS

FIELD OF THE INVENTION

The present invention is related to a printing unit in a lithographic web fed rotary printing press for performing on the run changes of the printing plates mounted to the plate cylinders of the unit. Moreover, the present invention is related to a method for deactivating the printing operation in a printing unit of a web fed rotary printing press.

BACKGROUND OF THE INVENTION

In web fed rotary printing presses, which are e.g. used for printing commercials or for printing newspapers, it is often desired to change one or more printing plates mounted to the plate cylinders of the press, without interrupting the printing operation. An exchange of the printing plates may for instance be desirable, if during a running newspaper production, the latest news have to be actualized and printed on the front page of the current editions or if different editions of the same newspaper are distributed in different areas under different names, so that the title of the newspaper has to be changed during the production run.

U.S. Pat. No. 5,063,844 describes a lithographic rotary printing press having a blanket-to-blanket printing unit, in which two plate cylinders can be alternatingly engaged and disengaged with one of the blanket cylinders, in order to carry out a flying plate exchange, while the printing press is in operation. During the flying plate exchange, both blanket cylinders of the printing unit are driven and are in rolling contact with the running paper web, while the plate cylinder which has been disengaged from the blanket cylinder is disconnected from the common drive motor, decelerated to a stop and re-accelerated after the printing plates have been changed.

German Patent DE 44 05 658 C2 describes a printing unit of a lithographic web fed rotary printing press for carrying out an on the run exchange of printing plates. The printing unit comprises two blanket cylinders and associated plate cylinders respectively, which are alternately engaged and disengaged with an impression cylinder over which the running web is passed. Each of the blanket cylinders is driven by its own separate motor and drives the associated plate cylinder via a gear train. The impression cylinder is driven by a further separate motor.

GB 2 309 668 discloses a blanket-to-blanket printing unit for carrying out a flying plate exchange in which the plate cylinders remain in rolling contact with the running web, while the blanket cylinders of the unit are alternately engaged and disengaged with their associated blanket cylinder. The blanket cylinders are constantly coupled to each other via meshing pinion gears and are driven by the main drive motor of the press via a line shaft. The blanket cylinders, however, are coupled to the pinion gears of the blanket cylinders via clutches and associated further pinion gears respectively. For exchanging the printing plates of one of the plate cylinders, while the press is in operation, the drive connection to the plate cylinder is interrupted by activating the respective clutch and the plate cylinder is decelerated by an auxiliary motor. After exchanging the printing plates, the auxiliary motor re-accelerates the plate cylinder up to press speed, before it is reengaged with its associated blanket cylinder. Hence, at least two auxiliary motors are required for performing a flying plate exchange. The document further describes the arrangement of two flying imprinter printing units on top of each other, wherein the engagement and disengagement of the plate cylinders and blanket cylinders is performed crosswise, in order to provide for a continuous printing operation.

OBJECT TO THE INVENTION

It is an object of the present invention to provide for a printing unit of a lithographic web fed rotary printing press, which is simple in design and which allows to carry out a flying exchange of the printing plates or maintenance work at the plate cylinders without employing auxiliary drive motors for decelerating and re-accelerating the plate cylinders.

According to a first object of the present invention, a method for deactivating the printing operation in a printing unit of a web fed rotary printing press, in which a blanket cylinder and an associated plate cylinder are driven by a first drive motor and the blanket cylinder is under impression with an associated impression cylinder which is driven by a second drive motor comprises the steps of interrupting the drive connection between the first drive motor and the blanket cylinder, so that the blanket cylinder is friction driven by the web and separating the plate cylinder from the blanket cylinder for carrying out an exchange of the printing plate or the printing plates on the plate cylinder. After separating or disengaging the plate cylinder from the blanket cylinder, the plate cylinder is decelerated by reducing the speed of the first drive motor, while the other drive motor for driving the impression cylinder is driven with web speed. The impression cylinder is preferably the second blanket cylinder in a blanket-to-blanket printing unit.

According to a further object of the present invention, a printing unit in a lithographic web fed rotary printing press comprises a plate cylinder and an associated blanket cylinder which are mechanically coupled via gears. A first drive motor drives the plate cylinder and the blanket cylinder. An impression cylinder is in rolling contact with the blanket cylinder and is driven by a second drive motor, via a clutch, which allows interrupting the drive connection between the first drive motor and the blanket cylinder, while the blanket cylinder is under impression with the impression cylinder. When the clutch is separated, the blanket cylinder is friction-driven with web speed by the running web and a throw-off mechanism for separating the plate cylinder from the blanket cylinder is operated while the blanket cylinder is in rolling contact with the impression cylinder.

According to a further object of the present invention, the blanket cylinder, the plate cylinder and an inker roller associated with the plate cylinder are mechanically coupled via a gear train. The gear train may include pinion gears and the clutch is preferably located between the pinion gear for driving the blanket cylinder and the blanket cylinder body.

According to a further embodiment of the present invention, the impression cylinder is a further blanket cylinder of a blanket-to-blanket printing unit.

According to yet another exemplary embodiment of the present invention, the second blanket cylinder and its associated plate cylinder form a print couple which is designed in the same way as the print couple formed by the first blanket cylinder and its associated first plate cylinder for carrying out a flying plate exchange.

According to a further embodiment of the present invention, two or more of the printing units for carrying out a flying plate exchange may be arranged on top of each other or side by side, whereby the exchange of the printing plates may be carried out crosswise, so that a continuous operation of the printing press is obtained.

According to another embodiment of the present invention, the printing blankets mounted to the blanket cylinders are sleeve-shaped endless printing blankets which can be axially moved onto the cantilevered blanket cylinder body e.g. by means of compressed air, when the press is stopped. This has the advantage, that even a slight migration of the friction driven blanket cylinder does not result in a dislocation of the cylinder-gap relative to the printed image, as it may occur in case of conventional printing blankets.

It is an advantage of the present invention that the power transmission path from the drive motors to the cylinders avoids unloaded components and minimizes undesirable torsional movements of the plate and blanket cylinders, because the inker unit which is in contact with the plate cylinder loads the plate cylinder and the plate cylinder in turn loads the blanket cylinder and the drive motor. As a result, even a certain amount of backlash between the teeth of the gear wheels of the gear train does not lead to "doubling" or other print defects when the speed of the drive motor is reduced during the operation of the printing press and the cylinders of the press tend to keep on rotating due to their moment of inertia.

BRIEF DESCRIPTION OF THE DRAWINGS

Other objects and advantageous of the present invention will become apparent to those skilled in the art from the following detailed description of preferred embodiments, when read in conjunction with the accompanying drawings, wherein like elements have been designated with like reference numerals and wherein.

DETAILED DESCRIPTION OF THE PREFERRED EMBODIMENTS

Figure 1:
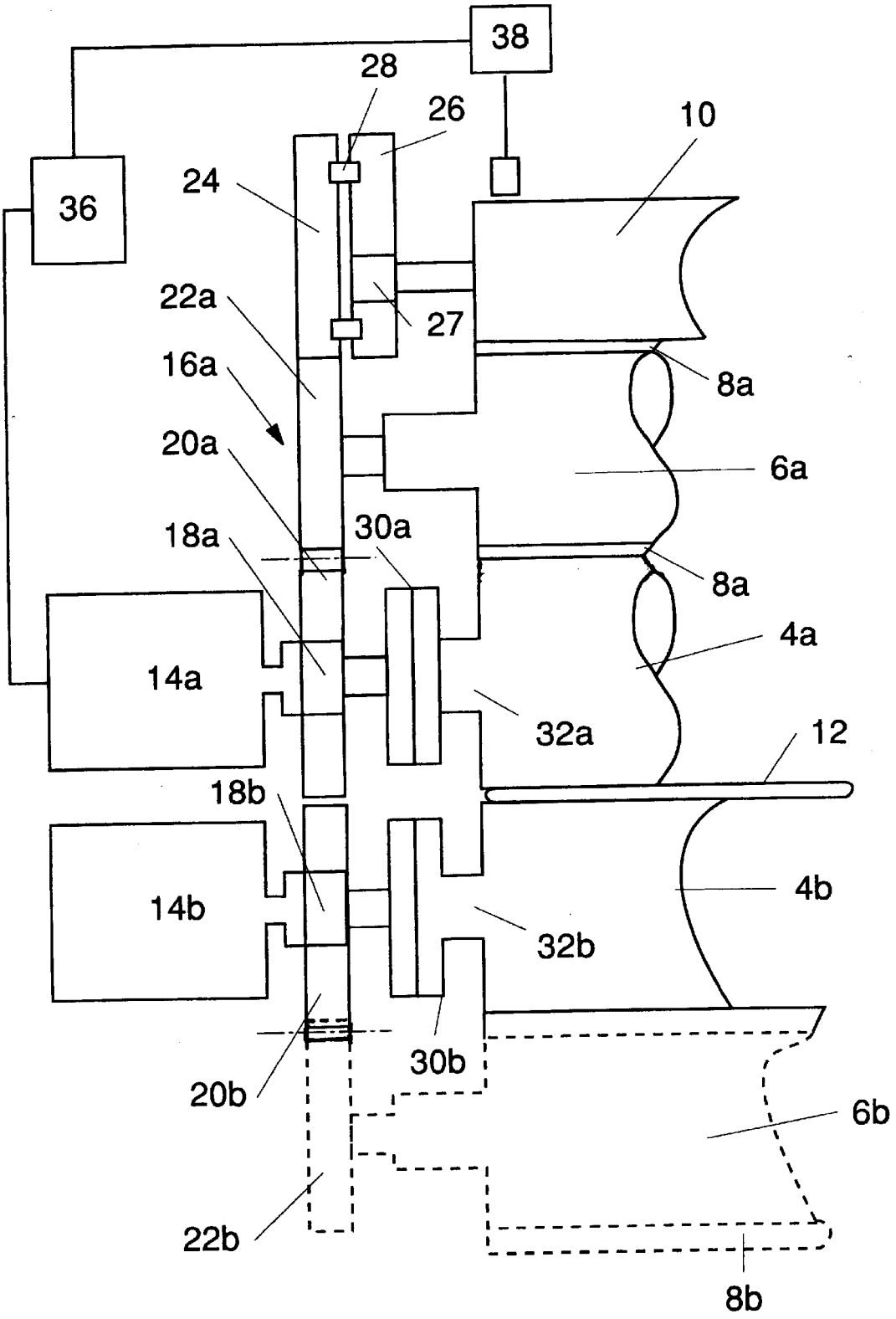
FIG. 1 is a schematic overview of a printing unit of a web fed rotary printing press according to the present invention, in which the upper blanket cylinder is coupled to the drive motor and the image is transferred from the upper plate cylinder to the upper side of the web.

FIG. 1 shows a printing unit 1 for a web fed rotary printing press 2 in accordance with the present invention. The printing unit 1 includes a first blanket cylinder 4*a* and a first plate cylinder 6*a* on which a lithographic printing plate, e.g. an endless sleeve-shaped printing plate or a conventional flat printing plate 8*a* is mounted. An inker roll 10 for inking the lithographic printing plate is associated with the first plate cylinder 6*a*. An impression cylinder 4*b* which is preferably the second blanket cylinder of a blanket-to-blanket printing unit of a lithographic web fed rotary printing press is in rolling contact with the first blanket cylinder 4*a*. A web 12 is running between the first blanket cylinder 4*a* and the impression cylinder or second blanket cylinder 4*b*, to be printed on its first and/or second side, respectively. Although the impression cylinder 4*b* may be a single chrome plated cylinder which does not necessarily have to be in rolling contact with a further plate cylinder, the impression cylinder 4*b* is preferably the second blanket cylinder of a known blanket-to-blanket printing unit which is in rolling contact with an associated plate cylinder 6*b*, as it is indicated in dashed lines in FIG. 1 and 2. Therefore, the impression cylinder may hereinafter be referred to as the second blanket cylinder 4*b*. The printing blankets mounted to the blanket cylinders 4*a*, 4*b* are preferably endless sleeve-shaped printing blankets, but may also be conventional blankets.

Figure 2:
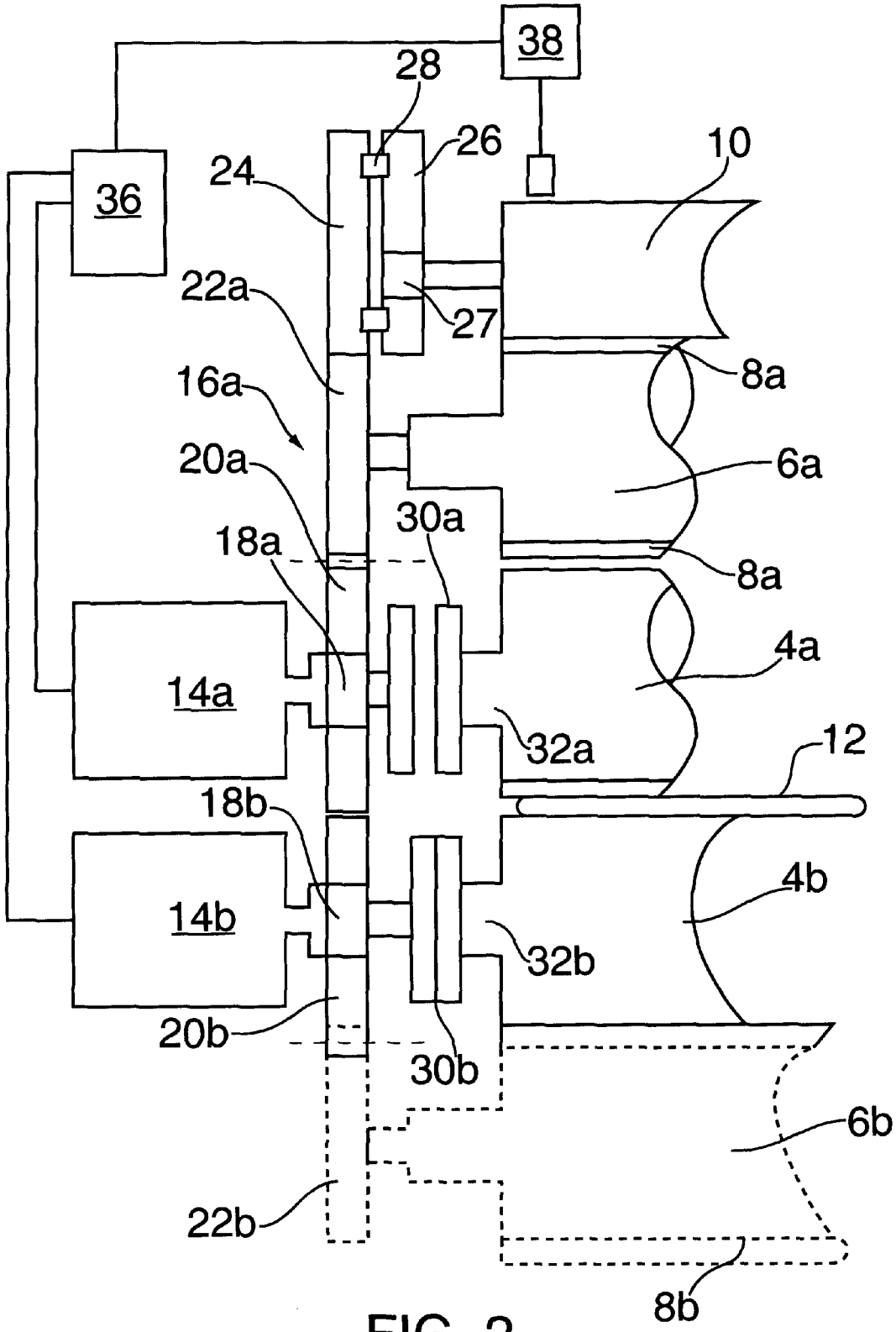
FIG. 2 is the printing unit of FIG. 1, in which the drive connection to the first drive motor for driving the blanket cylinder is interrupted and the blanket cylinder is friction-driven by the web, and in which the associated plate cylinder is disengaged from the blanket cylinder and decelerated by the first drive motor.

A first drive motor 14*a* for driving the first plate cylinder 6*a* and blanket cylinder 4*a* is mounted to a not shown housing of the printing press. The first plate cylinder 6*a* and its associated first blanket cylinder 4*a* may be coupled via a gear train 16*a* as it is shown in FIGS. 1 and 2. The first drive motor 14*a* may include a pinion gear 18*a* which drives into a drive gear 20*a* of the gear train 16*a* associated with the first blanket cylinder 4*a*. The drive gear 20*a* is in meshing engagement with a drive gear 22*a* mounted to the main drive shaft of the first plate cylinder 6*a*.

As it is shown in FIG. 1, the gear train 16*a* may further comprise gear wheels 24, 26, 27 for driving the inker roll 10 or the entire inker unit for inking the first plate cylinder 6*a*. As it is indicated in FIG. 1 and 2, the gear wheels 24, 26 may be coupled via a resilient element 28, thereby forming a resilient coupling or compliant drive as it is known from prior art printing presses, in order to eliminate the transmission of mechanical disturbances to the gear train 16*a*, which may for instance be caused by the intermittent motion of vibrator rollers or ink metering rollers (not shown) in the inker unit.

A clutch 30*a* for interrupting the drive connection between the gear train 16 and the first blanket cylinder 4*a* is preferably mounted to the drive shaft 32*a* of the first blanket cylinder 4*a*. The clutch 30*a* may be any type of known clutch, but is preferably a clutch which only allows the coupling of the first blanket cylinder 4*a* to the associated drive gear 20*a* at a predetermined position. Clutches of the afore-mentioned type are for example known from GB 2 309 668.

The printing unit 1 in accordance with the present invention further comprises a throw-off mechanism 34*a* for disengaging the first plate cylinder 6*a* from the first blanket cylinder 4*a* while the printing press 2 is in operation. The distance by which the first plate cylinder 6*a* can be separated from the first blanket cylinder 4*a* by the throw-off mechanism 34*a* is preferably such that the printing plate 8*a* of the first plate cylinder 6*a* can be easily wrapped around the body of the plate cylinder 6*a* without touching the surface of the first blanket cylinder 4*a*. On the other hand, the distance by which the first plate cylinder 6*a* can be separated form the first blanket cylinder 4*a* is preferably so small that the gear wheels 20*a* and 22*a* are still in meshing engagement, when the cylinders are disengaged. The throw-off mechanism 34*a* can be any known type of throw-off mechanism, as it is used in prior art printing presses.

Figure 3:
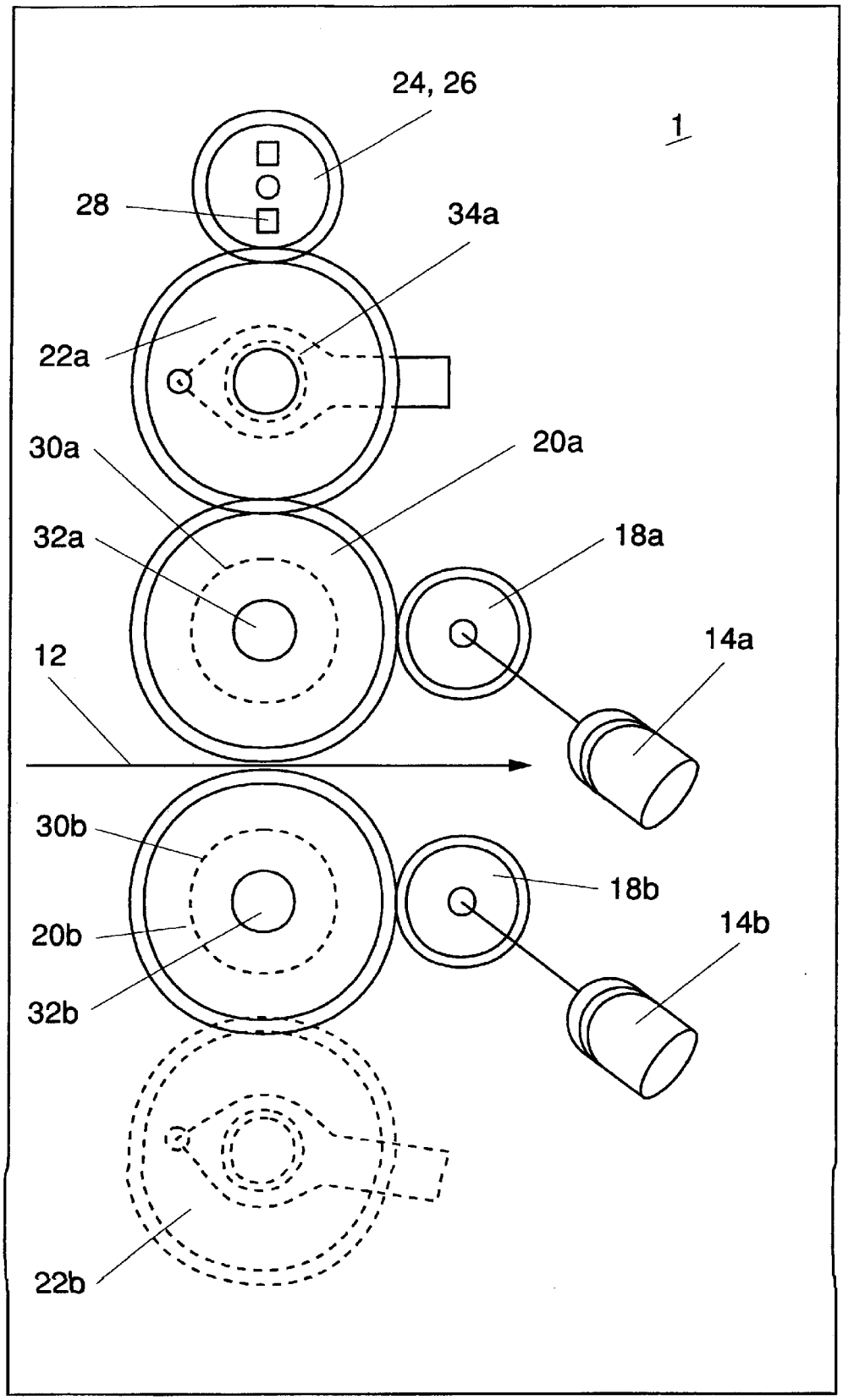
FIG. 3 is a schematic sideview of the throw-off mechanisms for engaging and disengaging the plate cylinders and the gear train of a blanket-to-blanket printing unit according to the present invention with the associated drive motors for separately driving the left and the right blanket cylinders.

A schematic sideview of the afore described gears and drive motors of an exemplary embodiment of a printing unit 1 according to the present invention is schematically shown in FIG. 3.

The printing unit 1 according to the present invention further comprises a second drive motor 14*b* for driving the impression cylinder or second blanket cylinder 4*b*. In the same way as the first drive motor 14*a*, the second drive motor 14*b* may drive the second blanket cylinder 4*b* via a pinion gear 18*b* and a drive gear 20*b* associated with the second blanket cylinder 4*b*. A clutch 30*b* may be mounted between the drive gear 20*b* and the drive shaft 32*b* of the second blanket cylinder 6*b*, in the case of a blanket-to-blanket printing unit, in which the upper and the lower couples can be operated in alternation as an imprinter.

According to another embodiment of the present invention, it is also conceivable that the first and/or the second drive motors 14*a*, 14*b* may be directly connected to the drive shaft 32*a*, 32*b* of the first and/or second blanket cylinders 4*a*, 4*b*, respectively. Moreover, the first drive motor 14*a* may also be driving into the drive gear 22*a* of the first plate cylinder 6*a* and in case that a second plate cylinder 6*b* is associated with the second blanket cylinder 4*b*, the second drive motor 14*b* may be driving into the drive gear 22*b* mounted to the drive shaft of the second plate cylinder 6*b*. In the same way, the first and the second drive motor 14*a*, 14*b*, may also be driving directly into the drive shafts of the first and second plate cylinders 16*a*, 6*b*, respectively.

For exchanging the printing plate or the printing plates 8*a* on the first plate cylinder 6*a* of the printing unit 1 during a production run of the printing press 2, the clutch 30*a* is disengaged, e.g. by a not shown actuator, in order to interrupt the drive connection between the first drive motor 14*a* and the first blanket cylinder 4*a*. Due to the rolling engagement between the first blanket cylinder 4*a* and the web 12 and further to the friction between the web 12 and the impression cylinder or second blanket cylinder 4*b* which is driven at press speed by the second drive motor 14*b*, the first blanket cylinder 4*a* is friction driven by the web 12 and therefore rotates with substantially the same speed as the web 12. In case that a further clutch 30*b* is mounted to the drive shaft 32*b* of the second blanket cylinder 4*b*, as it is indicated by dashed lines in FIG. 1 and FIG. 2, this clutch 30*b* is engaged accordingly, in order to obtain a drive connection between the second drive motor 14*b* and the shaft 32*b* of the second blanket cylinder 4*b*.

After interrupting the drive connection between the first drive motor 14*a* and the first blanket cylinder 4*a* by opening the clutch 30*a*, the throw-off mechanism 34*a* is activated and the first plate cylinder 6*a* is separated from the first blanket cylinder 4*a*, as it is shown in FIG. 2, while the drive gears 20*a* and 22*a* of the first blanket and plate cylinders 4*a*, 6*a* remain in a meshing engagement.

In a next step, the speed of the first drive motor 14*a* is reduced, preferably constantly, in order to decelerate the first plate cylinder 6*a* via the gear train 16*a*. After the first plate cylinder 6*a* has come to a stop, the press operator can exchange the printing plates 8*a* mounted to the first plate cylinder, while at the same time the web 12 is traveling through the printing unit 1 with web speed, and in case of a blanket-to-blanket printing unit may be printed by the second blanket cylinder 4*b* and its associated second plate cylinder 6*b*, as it is indicated in dashed lines in FIGS. 1 and 2.

After the press operator has completed his maintenance work or has exchanged the printing plates 8*a*, the first plate cylinder 6*a* is re-accelerated by the first drive motor 14*a* preferably via the pinion gear 18*a*, the blanket cylinder drive gear 20*a* and the plate cylinder drive gear 22*a*, while the clutch 30*a* remains disengaged and the first blanket cylinder 4*a* is friction driven by the web 12 traveling at press speed. After the first drive motor 14*a* has re-accelerated the first plate cylinder 6*a* to press speed, the angular position of the first plate cylinder 6*a* may be altered, preferably by advancing or retarding the first drive motor 14*a*, until the register of the first plate cylinder 6*a* is adjusted, in case that a misregistering has occurred. For controlling the rotation of the first drive motor 14*a*, the first drive motor 14*a* may be electrically coupled to a control unit 36 which may receive register control signals from a register control unit 38, which in turn may be coupled to a register sensor for sensing register signals from the printing plate 8*a* of the first plate cylinder 6*a* or the web 12. Register control devices are known in the prior art and are therefore not further described in detail.

After the correct angular position or phase and/or the rotational speed of the first plate cylinder 6*a* has been adjusted, the clutch 30*a* is engaged so that the first blanket cylinder 4*a* is again driven by the first drive motor 14*a*. Afterwards, the throw-off mechanism 34*a* is activated to reengage the first plate cylinder 6*a* with the first blanket cylinder 4*a*.

According to a further embodiment of the present invention, it is also possible to separate the first plate cylinder 6*a* from the first blanket cylinder 4*a* by activating the throw-off mechanism 34*a*, before disengaging the clutch 30*a* and decelerating the first drive motor 14*a* driving the first plate cylinder 6*a*.

According to a further exemplary embodiment of the present invention, the lower print couple formed by the second blanket cylinder 4*b* and second plate cylinder 6*b* of FIGS. 1 and 2 may be designed in the same way as the upper print couple, in order obtain the possibility to carry out an exchange of the printing plates 8*b* mounted to the second plate cylinder 6*b* of FIGS. 1 and 2, while the printing press 2 is in operation. In this embodiment of the invention, the first (upper) plate cylinder 6*a* of printing unit 1 may be disengaged from its associated first blanket cylinder 4*a* which in this case is friction driven by the web 12, while the (lower) plate cylinder 6*b* of printing unit 1 remains engaged with its associated (lower) blanket cylinder 4*b* which is actively driven by the second drive motor 14*b*, as it is shown in full lines at the example of printing unit 1 in FIG. 4. In another mode of operation, which is indicated by the dashed lines for the printing unit 1 of FIG. 4, the upper plate cylinder 6*a* may be engaged with its associated upper blanket cylinder 4*a* which is actively driven by the first drive motor 14*a* via the engaged clutch 30*a*, whereas the drive connection to the lower blanket cylinder 4*b* may be interrupted, for instance by disengaging the further clutch 30*b* in FIGS. 1 and 2, while the (lower) second plate cylinder 6*b* is disengaged from its associated blanket cylinder 4*b* and is decelerated by the second drive motor 14*b* to a stop for exchanging the printing plates 8*b* or performing some maintenance work at the second plate cylinder 6*b* in the same way as described herein before, for the upper print couple.

Figure 4:
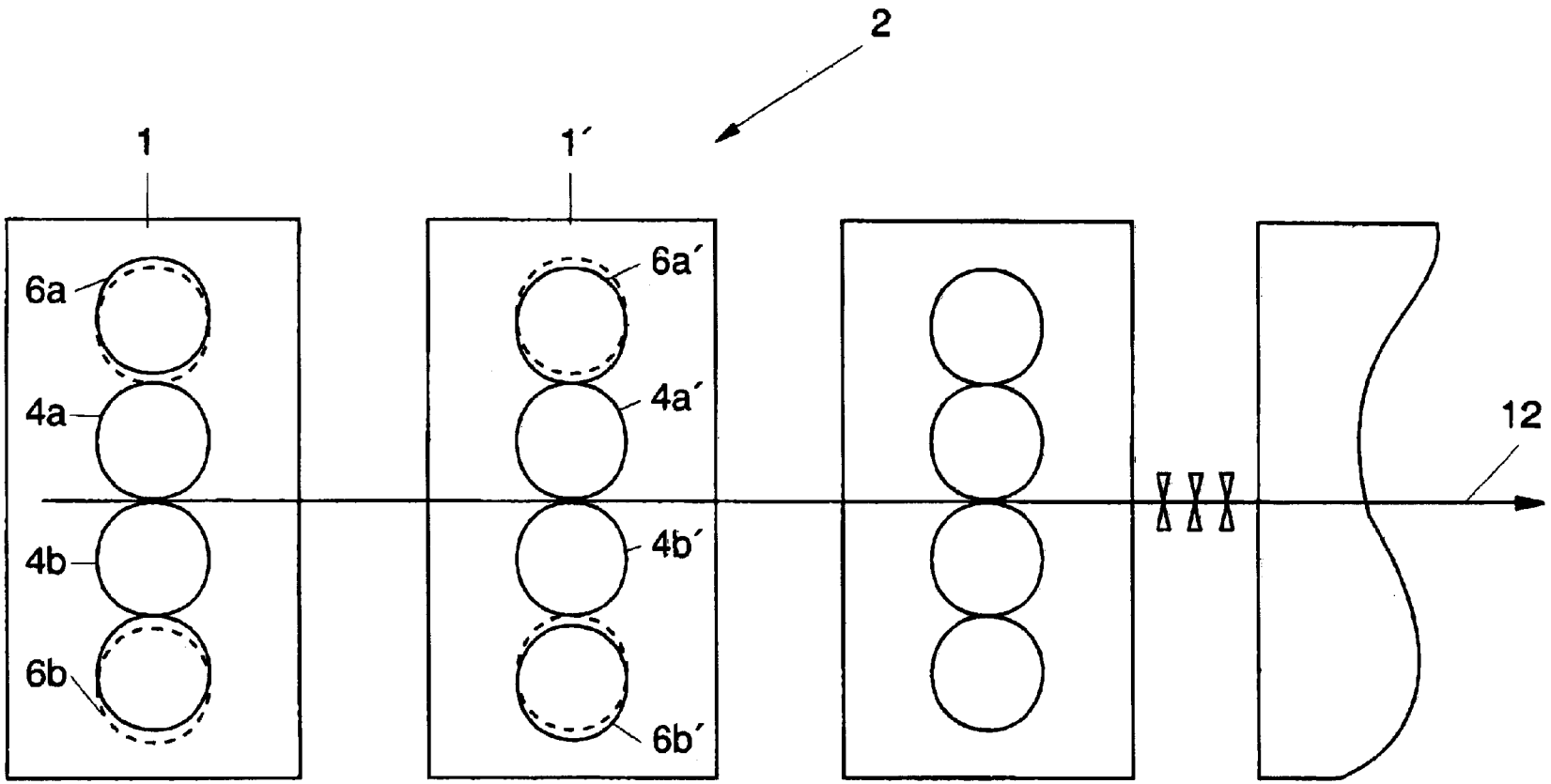
FIG. 4 is a schematic overview of a web fed rotary printing press with a first and a second printing unit according to the present invention, in which the plate cylinders of the units are engaged and disengaged crosswise, respectively, in order to carry out a continuous operation of the printing press during the flying exchange of printing plates.

As it is further indicated in FIG. 4, a second printing unit 1' may be located beside or above the printing unit 1, with the web 12 traveling through both printing units 1 and 1'. In this embodiment of the invention, the first (upper) plate cylinder 6*a* of the upstream printing unit 1 and the lower (second) plate cylinder 6*b'* of the downstream printing unit 1' may be disengaged from their associated blanket cylinders 4*a*, 4*b'*, e.g. for exchanging the printing plates, whereas the second (lower) plate cylinder 6*b* of printing unit 1 and a first (upper) plate cylinder 6*a'* of printing unit 1' may be engaged with their associated blanket cylinders 4*b*, 4*a'* for printing on the web 12 respectively (full lines in FIG. 4).

After printing plates for a new print job or another edition of a newspaper e.g. for a different local region have been mounted on the respective plate cylinders 6*a* and 6*b*', the printing units 1 and 1' are set up in the configuration as indicated in dashed lines in FIG. 4 in the way described herein before, respectively. In other words, for carrying out a flying imprinter operation of the printing press 2, the plate cylinders 6*a*, 6*b*', 6*b* and 6*a*' are engaged and disengaged with their associated blanket cylinder crosswise in the way described herein before, respectively with the web 12 being printed on one or on both sides.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and non-restrictive. The scope of the present invention is indicated by the appended claims, rather than the foregoing description, and all changes that come within the meaning and range and equivalence thereof are intended to be embraced therein.

What is claimed is:

1. A method for deactivating the printing operation in a printing unit of a web fed rotary printing press, wherein a blanket cylinder and an associated plate cylinder are driven by a common first drive motor and the blanket cylinder is under impression with an associated impression cylinder which is driven by a second drive motor, and wherein the web passes through a nip formed between the blanket cylinder and the impression cylinder, the method comprising the steps of:

interrupting a drive connection between the first drive motor and the blanket cylinder; and separating the plate cylinder from the blanket cylinder, wherein the blanket cylinder remains in rolling contact with the associated impression cylinder and is friction-driven by the web after the drive connection of the first drive motor has been interrupted.

2. The method of claim 1 further comprising decelerating the plate cylinder after the separating of the plate cylinder from the blanket cylinder.

3. The method of claim 2 wherein the decelerating is performed by reducing a speed of the first drive motor.

4. The method of claim 1 wherein the drive connection between the first drive motor and the blanket cylinder is interrupted before the separating of the plate cylinder from the blanket cylinder.

5. The method of claim 1 wherein the drive connection between the first drive motor and the blanket cylinder is interrupted after the separating the plate cylinder from the blanket cylinder.

6. The method of claim 1 wherein the interruption of the drive connection between the first drive motor and the blanket cylinder and the separating of the plate cylinder from the blanket cylinder are performed at substantially the same time.

7. The method of claim 1 further comprising decelerating the plate cylinder to a stop.

8. The method of claim 1 wherein the plate cylinder is re-accelerated by the first drive motor until a speed and angular position of the plate cylinder matches with a speed and an angular position of the blanket cylinder.

9. The method of claim 8 wherein a clutch is re-engaged after the speed and the angular position of the blanket cylinder have been matched.

* * * * *